US010635023B2

(12) United States Patent
Ishii et al.

(10) Patent No.: US 10,635,023 B2
(45) Date of Patent: Apr. 28, 2020

(54) TONER CASE INCLUDING AGITATOR AGITATING TONER AND IMAGE FORMING APPARATUS INCLUDING TONER CASE

(71) Applicant: KYOCERA Document Solutions Inc., Osaka (JP)

(72) Inventors: Akira Ishii, Osaka (JP); Koshiro Tomimori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/437,381

(22) Filed: Jun. 11, 2019

(65) Prior Publication Data

US 2019/0384207 A1 Dec. 19, 2019

(30) Foreign Application Priority Data

Jun. 15, 2018 (JP) ..... 2018-114361

(51) Int. Cl.
*G03G 15/08* (2006.01)
*G03G 21/16* (2006.01)

(52) U.S. Cl.
CPC ..... *G03G 15/0889* (2013.01); *G03G 15/0891* (2013.01); *G03G 21/1647* (2013.01); *G03G 2215/085* (2013.01); *G03G 2215/0819* (2013.01); *G03G 2221/1657* (2013.01)

(58) Field of Classification Search
CPC ..... G03G 15/0889; G03G 15/0891; G03G 21/1647; G03G 2215/0819; G03G 2215/0827; G03G 2215/085; G03G 2221/1657
USPC ..... 399/254, 256
See application file for complete search history.

(56) References Cited

U.S. PATENT DOCUMENTS 8,055,161 B2 * 11/2011 Kim ..... G03G 15/0877 399/254
2005/0238389 A1 * 10/2005 Kim ..... G03G 15/087 399/238
2013/0022375 A1 * 1/2013 Shin ..... G03G 15/0808 399/281
2013/0084106 A1 * 4/2013 Tsuda ..... G03G 15/0891 399/258
2016/0306295 A1 * 10/2016 Ishii ..... G03G 15/0889

FOREIGN PATENT DOCUMENTS

JP 04350869 A * 12/1992
JP 2011186102 A 9/2011

* cited by examiner

*Primary Examiner* — Robert B Beatty
(74) *Attorney, Agent, or Firm* — Studebaker & Brackett PC

(57) ABSTRACT

A toner case includes a case main body, first and second agitators, and a transmitting mechanism. The case main body is configured to store a toner. The first and second agitators are configured to rotate and to agitate the toner in the case main body. A transmitting mechanism is configured to transmit rotation to the first and second agitators. The transmitting mechanism stops transmission of the rotation to the second agitator while the transmitting mechanism continues the transmission of the rotation to the first agitator, when driving torque of the second agitator is equal to or more than a first set value.

11 Claims, 6 Drawing Sheets

TONER CASE INCLUDING AGITATOR AGITATING TONER AND IMAGE FORMING APPARATUS INCLUDING TONER CASE

INCORPORATION BY REFERENCE

This application is based on and claims the benefit of priority from Japanese patent application No. 2018-114361 filed on Jun. 15, 2018, which is incorporated by reference in its entirety.

BACKGROUND

The present disclosure relates to a toner case and an image forming apparatus including the toner case.

An electrophotographic image forming apparatus includes a toner case to replenish a toner (a developer) to a developing device. For example, there is a toner case which includes a case main body configured to contain a toner and first and second agitators arranged rotatably and configured to agitate the toner inside the case main body.

SUMMARY

In accordance with an aspect of the present disclosure, a toner case includes a case main body, first and second agitators, and a transmitting mechanism. The case main body is configured to store a toner. The first and second agitators are configured to rotate and to agitate the toner in the case main body. A transmitting mechanism is configured to transmit rotation to the first and second agitators. The transmitting mechanism stops transmission of the rotation to the second agitator while the transmitting mechanism continues the transmission of the rotation to the first agitator, when driving torque of the second agitator is equal to or more than a first set value.

In accordance with an aspect of the present disclosure, an image forming apparatus includes the toner case.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus 1 according to an embodiment of the present disclosure will be described. Arrows Fr, Rr, L, R, U, and Lo suitably added to each figure respectively indicate a front side, a rear side, a left side, a right side, an upper side and a lower side of the image forming apparatus 1.

First, an entire structure of the image forming apparatus 1 will be described. The image forming apparatus 1 is, for example, a multifunctional peripheral complexly having a printing function, a copying function, a facsimile function, and the like.

Figure 1:
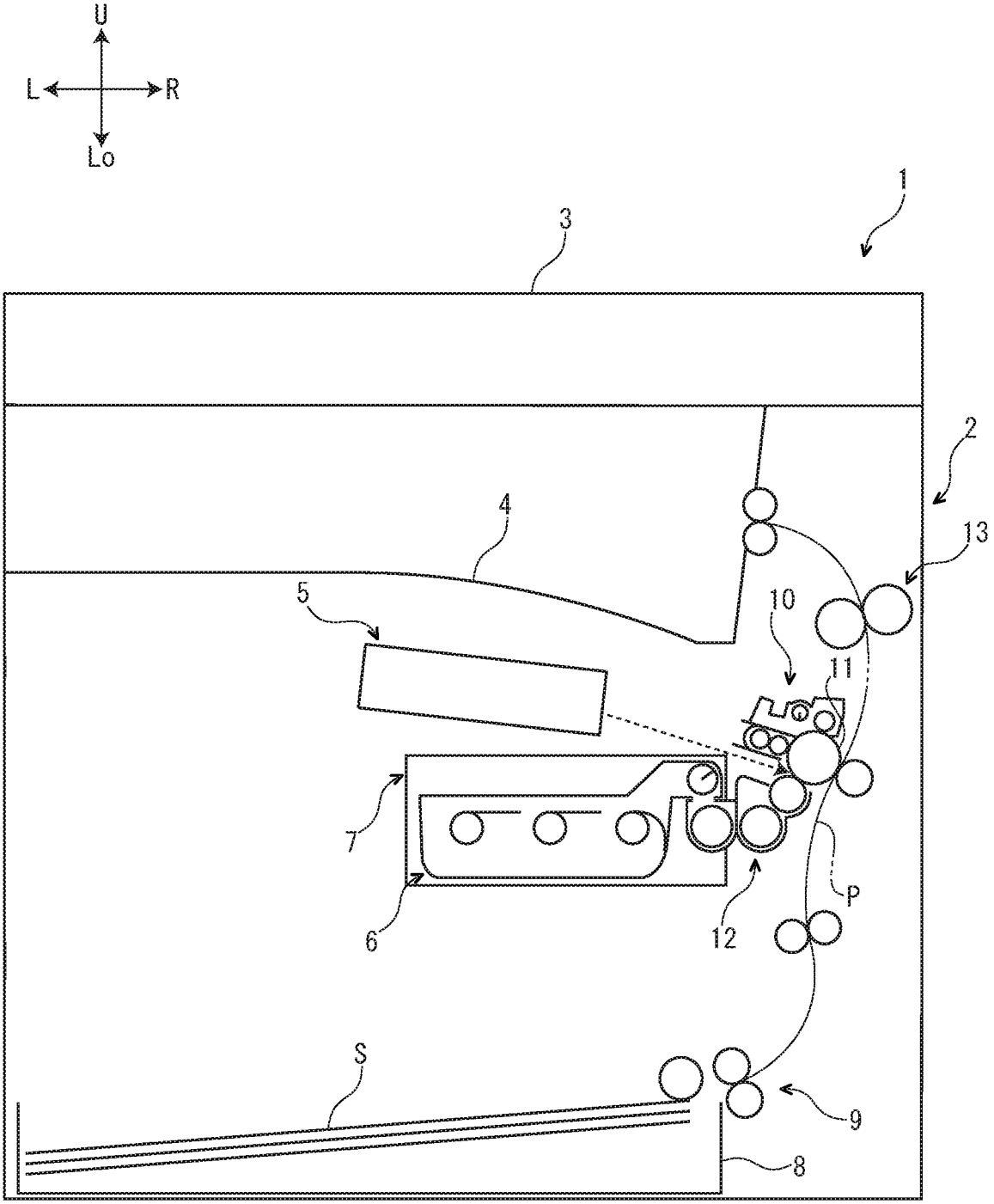
FIG. 1 is a schematic diagram showing an image forming apparatus according to an embodiment of the present disclosure.

With reference to FIG. 1, the image forming apparatus 1 includes a box-shaped apparatus main body 2. In an upper end part of the apparatus main body 2, an image reading device 3 to read an image of a document is arranged. In an upper part of the apparatus main body 2, an ejected sheet tray 4 is arranged. In a center part in an upper-and-lower direction of the apparatus main body 2, an exposing device 5 is arranged below the ejected sheet tray 4. In the center part in the upper-and-lower direction of the apparatus main body 2, a toner container 6 (an example a toner case) is stored below the exposing device 5. The toner container 6 is detachably attached to an attachment part 7. In a lower end part of the apparatus main body 2, a sheet feeding cassette 8 storing sheets S (an example of recording media) is stored.

In a right side part of the apparatus main body 2, a conveyance path P for the sheet S is arranged along the upper-and-lower direction. In an upstream end part of the conveyance path P, a sheet feeding part 9 is arranged. In a midstream part of the conveyance path P, an image forming part 10 is arranged. The image forming part 10 includes a photosensitive drum 11 (an example of an image carrier) and a developing device 12. In a downstream part of the conveyance path P, a fixing device 13 is arranged.

Next, an operation of the image forming apparatus 1 having the above configuration will be described.

First, in a state where a surface of the photosensitive drum 11 is uniformly charged, the exposing device 5 emits laser light (refer to a dotted line arrow in FIG. 1) to the surface of the photosensitive drum 11 to form an electrostatic latent image on the surface of the photosensitive drum 11. Next, the developing device 12 develops the electrostatic latent image to a toner image. Thereby, an image forming operation is completed.

On the other hand, the sheet S fed from the sheet feeding cassette 8 by the sheet feeding part 9 is conveyed to a downstream side in the conveyance path P, and enters the image forming part 10. At the image forming part 10, the toner image is transferred on the sheet S from the surface of the photosensitive drum 11. The sheet S on which the toner image is transferred is conveyed to the downstream side in the conveyance path P, and enters the fixing device 13. The fixing device 13 fixes the toner image on the sheet S. The sheet S on which the toner image is fixed is discharged from a downstream end part of the conveyance path P to the ejected sheet tray 4.

Next, the toner container 6 will be further described. An arrow I suitably added to each figure shows an inside in a front-and-rear direction of the toner container (a side close to a center part in the front-and-rear direction of the toner container 6). An arrow O suitably added to each figure shows an outside in the front-and-rear direction of the toner container 6 (a side away from the center part in the front-and-rear direction of the toner container 6).

Figure 2:
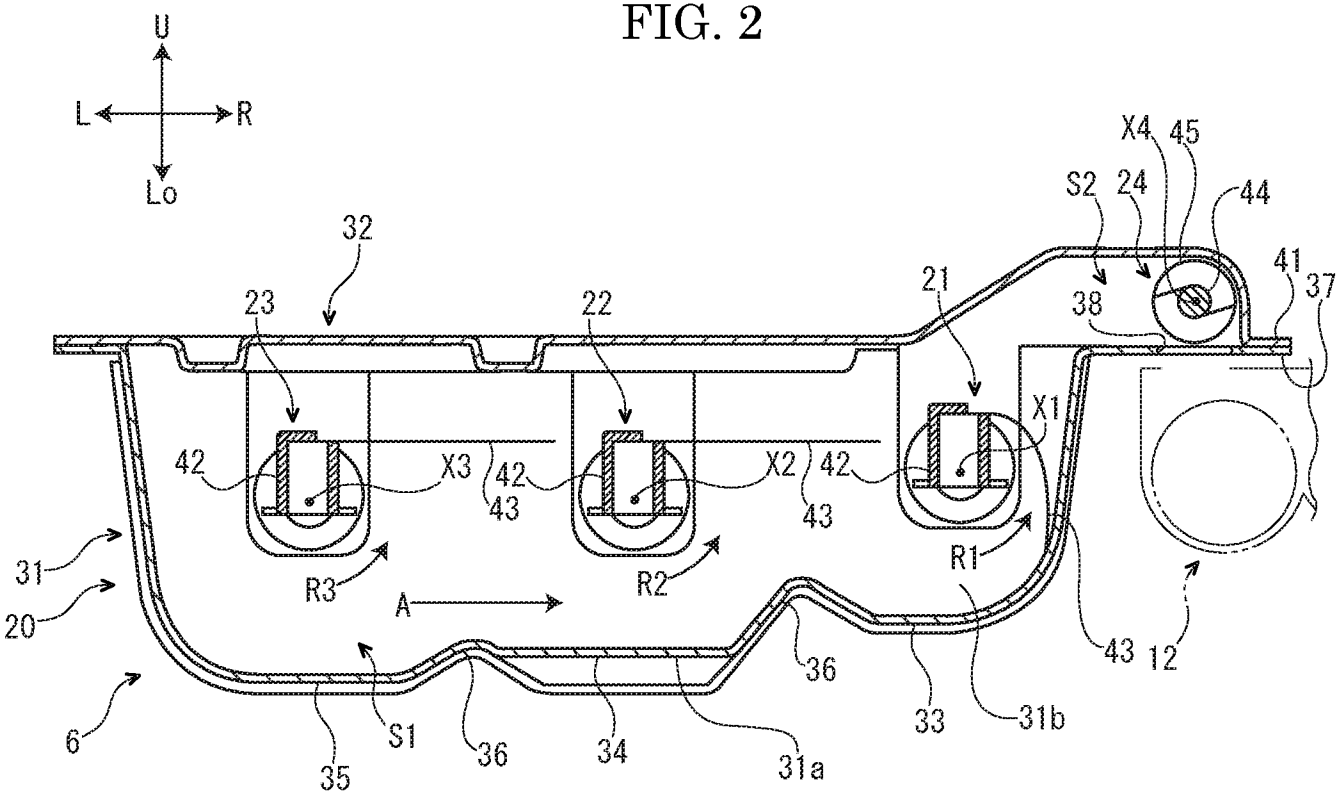
FIG. 2 is a sectional view showing a toner container according to the embodiment of the present disclosure.
Figure 3:
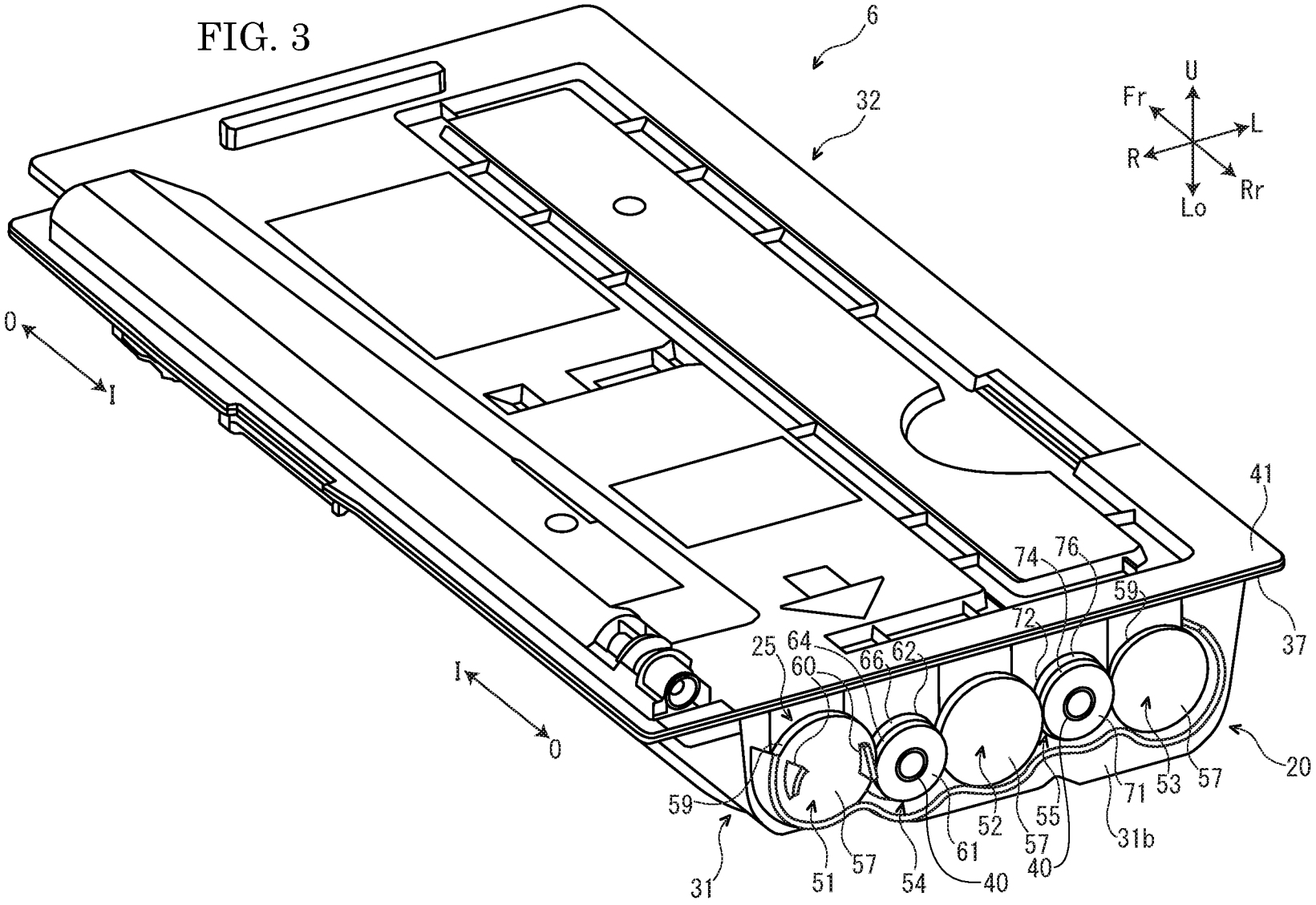
FIG. 3 is a perspective view showing the toner container according to the embodiment of the present disclosure.

With reference to FIGS. 2 and 3, the toner container 6 includes a case main body 20, first to third agitators 21-23 and a conveyer 24 stored in the case main body 20, and a transmitting mechanism 25 arranged at a rear side (the outside in the front-and-rear direction) of the case main body 20.

With reference to FIG. 2, a storage space S1 and a discharge space S2, which are communicated with each other, are arranged inside the case main body 20 of the toner container 6. The storage space S1 stores a toner (a developer). The discharge space S2 is positioned at a right upper side of the storage space S1, and is arranged higher than the storage space S1. Incidentally, an arrow A suitably added to each figure shows a toner conveying direction (hereinafter, "toner conveying direction A") from the storage space S1 to the discharge space S2.

The case main body 20 includes a box-shaped storing body 31 opened to an upper side, and a lid body 32 covering the upper side of the storing body 31.

In the bottom wall 31*a* of the storing body 31 of the case main body 20, a first wall 33 is arranged below the first agitator 21, a second wall 34 is arranged below the second agitator 22, and a third wall 35 is arranged below the third agitator 23. The first to third walls 33-35 are aligned in the order of the first wall 33, the second wall 34, and the third wall 35, from a downstream side to an upstream side in the toner conveying direction A. The first wall 33 is arranged higher than the second wall 34, and the second wall 34 is arranged higher than the third wall 35. Between the first wall 33 and the second wall 34, and between the second wall 34 and the third wall 35, recess parts 36 recessed upward are arranged, respectively.

On an outer circumference of an upper end of the storing body 31 of the case main body 20, a lower side flange 37 is arranged. In a right side part of the lower side flange 37, a discharge port 38 is arranged. The discharge port 38 is arranged right below the discharge space S2 of the case main body 20, and communicates with the discharge space S2 of the case main body 20. The discharge port 38 is opened and closed by a shutter (not shown).

Figure 4:
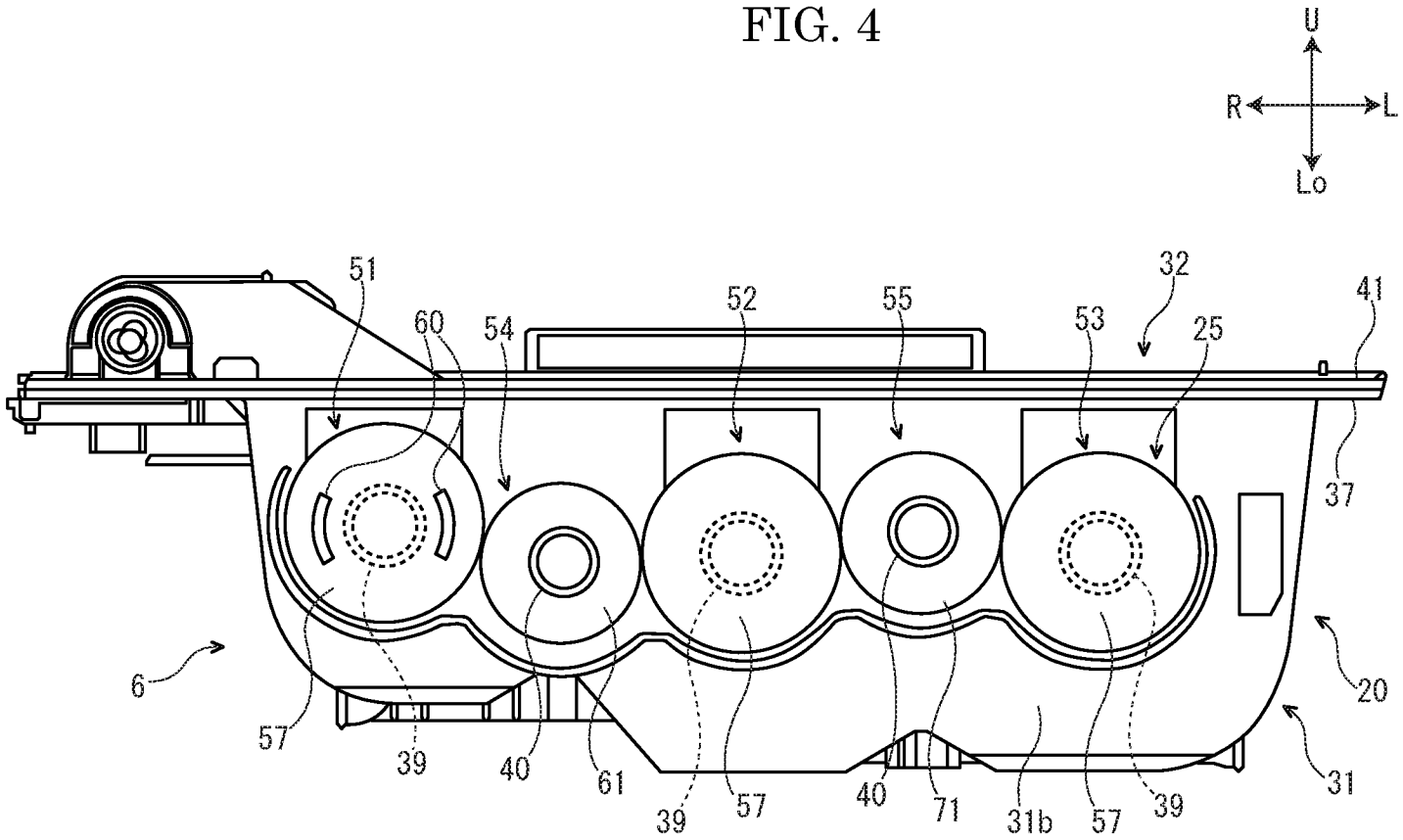
FIG. 4 is a rear view showing the toner container according to the embodiment of the present disclosure.
Figure 5:
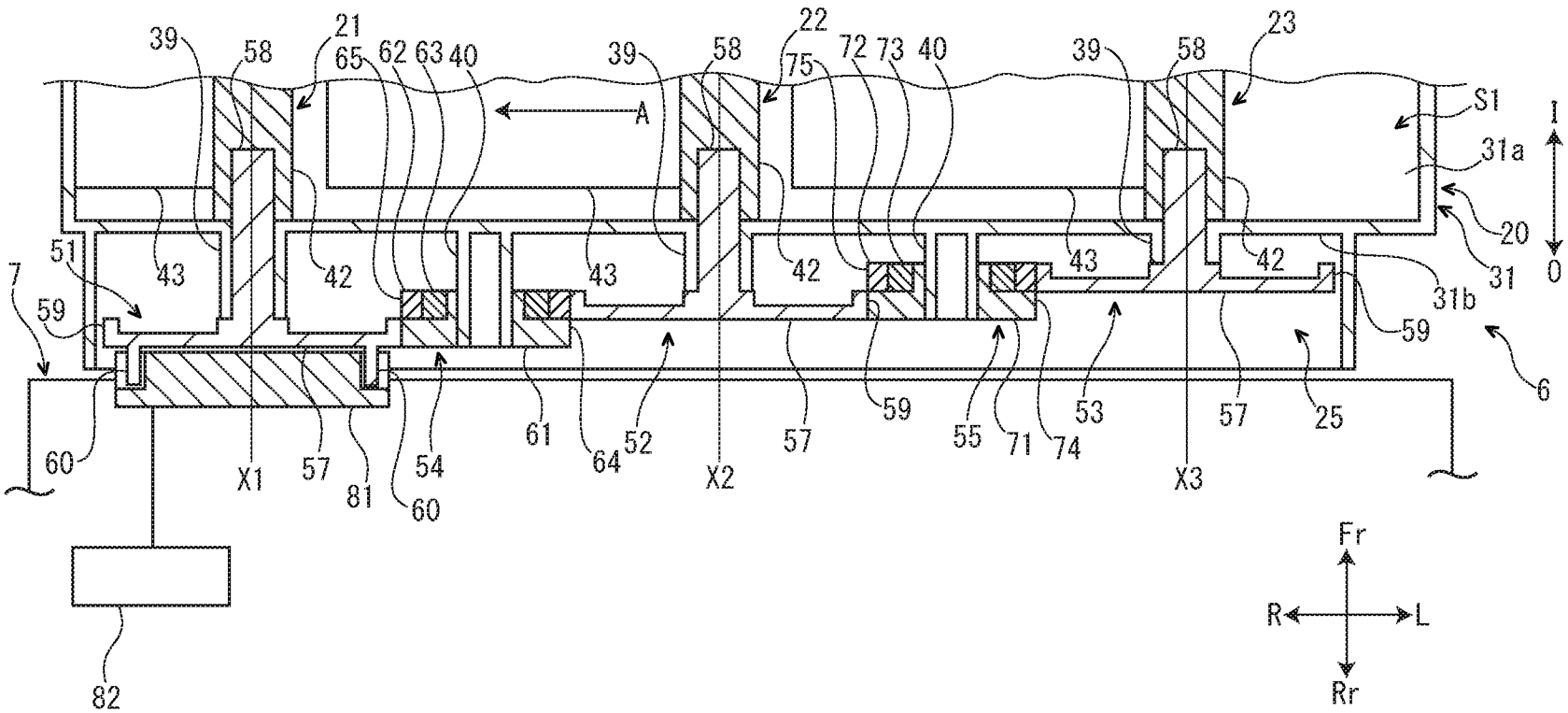
FIG. 5 is a sectional view showing a rear portion of the toner container and a rear portion of an attachment part according to the embodiment of the present disclosure.

With reference to FIGS. 4 and 5, in a rear end wall 31*b* (one end wall in the front-and-rear direction) of the storing body 31 of the case main body 20, three bosses 39 are arranged at intervals in a left-and-right direction. In the rear end wall 31*b* of the storing body 31, a pair of bosses 40 is arranged at the intervals of the three bosses 39. Each boss 39, 40 is formed in a cylindrical shape, and protrudes from a rear face (an outer face) of the rear end wall 31*b* to a rear side (an outside in the front-and-rear direction).

With reference to FIGS. 2 and 3, on an outer circumference of the lid body 32 of the case main body 20, an upper side flange 41 is arranged. The upper side flange 41 is fixed to the lower side flange 37 of the storing body 31. Thereby, the lid body 32 is integrated with the storing body 31.

With reference to FIG. 2, the first to third agitators 21-23 of the toner container 6 are stored in the storage space S1 of the case main body 20. The first to third agitators 21-23 are arranged at intervals in the left-and-right direction (a direction perpendicular to the front-and-rear direction). The first agitator 21 is arranged at a downstream side of the second agitator 22 in the toner conveying direction A, and the second agitator 22 is arranged at a downstream side of the third agitator 23 in the toner conveying direction A. That is, the first to third agitators 21-23 are aligned in the order of the first agitator 21, the second agitator 22, and the third agitator 23, from the downstream side to an upstream side in the toner conveying direction A.

The first agitator 21 is rotatable around a first rotation axis X1 extending along the front-and-rear direction (an example of one direction). The second agitator 22 is rotatable around a second rotation axis X2 extending along the front-and-rear direction. The third agitator 23 is rotatable around a third rotation axis X3 extending along the front-and-rear direction. That is, in the present embodiment, the front-and-rear direction is a rotation axis direction of the first to third agitators 21-23.

Each agitator 21-23 includes an agitating shaft 42 and an agitating blade 43 arranged on an outer circumference of the agitating shaft 42. The agitating shaft 42 extends along the front-and-rear direction. The agitating blade 43 is formed by resin film, and has flexibility. Abase end part (one end part in a width direction) of the agitating blade 43 is fixed to the agitating shaft 42. A tip end part (the other end part in the width direction) of the agitating blade 43 comes into contact with and separates from an inner face of the case main body 20, as each agitator 21-23 rotates.

The conveyer 24 of the toner container 6 is stored in the discharge space S2 of the case main body 20. The conveyer 24 is rotatable around a fourth rotation axis X4 extending along the front-and-rear direction. That is, in the present embodiment, the front-and-rear direction is a rotation axis direction of the conveyer 24. The conveyer 24 includes a conveying shaft 44 extending along the front-and-rear direction and a spiral conveying blade 45 arranged on an outer circumference of the conveying shaft 44.

With reference to FIGS. 3 to 5, the transmitting mechanism 25 of the toner container 6 includes first to third transmitters 51-53 and first and second connectors 54-55 arranged at intervals of the first to third transmitters 51-53.

The first to third transmitters 51-53 of the transmitting mechanism 25 are arranged at the intervals in the left-and-right direction. The first to third transmitters 51-53 are aligned in the order of the first transmitter 51, the second transmitter 52, and the third transmitter 53, from the downstream side to the upstream side in the toner conveying direction A.

Each transmitter 51-53 includes a transmitting piece 57 and a coupling piece 58 protruding from an inner circumference part of the transmitting piece 57 to a front side (an inside in the front-and-rear direction).

The transmitting piece 57 of each transmitter 51-53 is arranged outside the case main body 20. On an outer circumference of the transmitting piece 57, a transmitting gear 59 is arranged. On a rear face (an outer face) of the transmitting piece 57 of the first transmitter 51, transmitting couplings 60 are arranged.

The coupling piece 58 of each transmitter 51-53 extends along the front-and-rear direction. The coupling piece 58 penetrates through each boss 39 of the case main body 20, and is inserted into the storage space S1 of the case main body 20. Thereby, each transmitter 51-53 is rotatably supported by the case main body 20.

The coupling piece 58 of the first transmitter 51 is fixed to the agitating shaft 42 of the first agitator 21. Thereby, the first transmitter 51 is configured to rotate integrally with the first agitator 21. The coupling piece 58 of the second transmitter 52 is fixed to the agitating shaft 42 of the second agitator 22. Thereby, the second transmitter 52 is configured to rotate integrally with the second agitator 22. The coupling piece 58 of the third transmitter 53 is fixed to the agitating shaft 42 of the third agitator 23. Thereby, the third transmitter 53 is configured to rotate integrally with the third agitator 23.

The first and second connectors 54-55 of the transmitting mechanism 25 are arranged at an interval in the left-and-right direction. The first and second connectors 54-55 are arranged in the order of the first connector 54 and the second connecter 55, from the downstream side to the upstream side in the toner conveying direction A.

The first connector 54 includes a first driving piece 61, a first driven piece 62 arranged at a front side (an inside in the front-and-rear direction) of the first driving piece 61, and a first torque limiter 63 arranged between the first driving piece 61 and the first driven piece 62.

The first driving piece 61 of the first connector 54 is rotatably attached to an outer circumference of the right boss 40 of the case main body 20. Thereby, the first connector 54 is rotatably supported by the case main body 20.

On an outer circumference of the first driving piece 61 of the first connector 54, a first driving gear 64 is arranged. The first driving gear 64 meshes with the transmitting gear 59 of the transmitting piece 57 of the first transmitter 51. On an outer circumference of the first driven piece 62 of the first connector 54, a first driven gear 65 is arranged. The first driven gear 65 meshes with the transmitting gear 59 of the transmitting piece 57 of the second transmitter 52. As described above, the first connector 54 connects the first transmitter 51 with the second transmitter 52.

The first torque limiter 63 of the first connector 54 is, for example, a magnet type torque limiter or a spring type torque limiter. The first torque limiter 63 is not actuated and rotates the first driving piece 61 and the first driven piece 62 integrally, when driving torque of the second agitator 22 (torque needed to rotate the second agitator 22) is less than a first set value. The first torque limiter 63 is actuated and rotates the first driving piece 61 with respect to the first driven piece 62, when the driving torque of the second agitator 22 is equal to or more than the first set value.

The second connector 55 includes a second driving piece 71, a second driven piece 72 arranged at a front side (an inside in the front-and-rear direction) of the second driving piece 71, and a second torque limiter 73 arranged between the second driving piece 71 and the second driven piece 72.

The second driving piece 71 of the second connector 55 is rotatably attached to an outer circumference of the left boss 40 of the case main body 20. Thereby, the second connector 55 is rotatably supported by the case main body 20.

On an outer circumference of the second driving piece 71 of the second connector 55, a second driving gear 74 is arranged. The second driving gear 74 meshes with the transmitting gear 59 of the transmitting piece 57 of the second transmitter 52. On an outer circumference of the second driven piece 72 of the second connector 55, a second driven gear 75 is arranged. The second driven gear 75 meshes with the transmitting gear 59 of the transmitting piece 57 of the third transmitter 53. As described above, the second connector 55 connects the second transmitter 52 with the third transmitter 53.

The second torque limiter 73 of the second connector 55 is, for example, a magnet type torque limiter or a spring type torque limiter. The second torque limiter 73 is not actuated and rotates the second driving piece 71 and the second driven piece 72 integrally, when driving torque of the third agitator 23 (torque needed to rotate the third agitator 23) is less than a second set value. The second torque limiter 73 is actuated and rotates the second driving piece 71 with respect to the second driven piece 72, when the driving torque of the third agitator 23 is equal to or more than the second set value. The second set value at which the second torque limiter 73 is actuated is set to be equal to or less than the first set value at which the first torque limiter 63 is actuated.

Next, the attachment part 7 will be further described.

With reference to FIG. 5, in a rear part of the attachment part 7, a driving coupling 81 is arranged. The driving coupling 81 is coupled to the transmitting couplings 60 of the transmitting piece 57 of the first transmitter 51, in a state where the toner container 6 is attached to the attachment part 7. The driving coupling 81 is connected with a driving source 82 composed of a motor, and rotates by rotation driving force of the driving source 82.

Next, in the image forming apparatus 1 having the above described configuration, an example of a toner replenish operation from the toner container 6 to the developing device 12 will be described.

With reference to FIGS. 2 and 5, when the toner is replenished from the toner container 6 to the developing device 12, the driving source 82 is driven in the state where the toner container 6 is attached to the attachment part 7. When the driving source 82 is driven as described above, the driving coupling 81 rotates by the rotation driving force of the driving source 82. When the driving coupling 81 rotates as described above, the first transmitter 51, the transmitting couplings 60 of which is coupled to the driving coupling 81, rotates integrally with the driving coupling 81. When the first transmitter 51 rotates as described above, the first agitator 21 fixed to the first transmitter 51 rotates integrally with the first transmitter 51 (refer to an arrow R1 in FIG. 2).

Further, when the first transmitter 51 rotates as described above, rotation of the first transmitter 51 is transmitted to the second transmitter 52 via the first connector 54, and the second transmitter 52 rotates. When the second transmitter 52 rotates as described above, the second agitator 22 fixed to the second transmitter 52 rotates integrally with the second transmitter 52 (refer to an arrow R2 in FIG. 2).

Furthermore, when the second transmitter 52 rotates as described above, rotation of the second transmitter 52 is transmitted to the third transmitter 53 via the second connector 55, and the third transmitter 53 rotates. When the third transmitter 53 rotates, the third agitator 23 fixed to the third transmitter 53 rotates integrally with the third transmitter 53 (refer to an arrow R3 in FIG. 2).

As described above, the transmitting mechanism 25 transmits rotation to the first to third agitators 21-23, thereby the first to third agitators 21-23 rotate. When the first to third agitators 21-23 rotate as described above, the toner in the storage space S1 is agitated and conveyed to the discharge space S2 by the first to third agitators 21-23. Simultaneously, the toner in the storage space S1 is lifted to the discharge space S2 by the first agitator 21.

Further, when the driving source 82 is driven as described above, the conveyer 24 rotates by the rotation driving force of the driving source 82. When the conveyer 24 rotates as described above, the toner lifted to the discharge space S2 by the first agitator 21 is conveyed to the discharge port 38 by the conveyer 24. The toner conveyed to the discharge port 38 is discharged from the discharge space S2 via the discharge port 38, and introduced to the developing device 12. As described above, the toner is replenished from the toner container 6 to the developing device 12.

By the way, if the toner container 6 is vibrated during transportation or is stored for a long time, the toner may be aggregated in the case main body 20. If the toner is aggregated in the case main body 20 as described above, the driving torque of the first to third agitators 21-23 may become very large, and a great load may be applied to the driving part (in the present embodiment, the transmitting mechanism 25, the driving coupling 81, and the driving source 82) of the first to third agitators 21-23. In view of such a situation, the present embodiment stops the great load from being applied to the driving part of the first to third agitators 21-23, by the following way.

If the toner is aggregated in the case main body 20 when the toner container 6 starts to be used, the driving torque of the second agitator 22 is equal to or more than the first set value, and the driving torque of the third agitator 23 is equal to or more than the second set value.

When the rotation driving force of the driving source 82 is transmitted to the first connector 54 via the driving coupling 81 and the first transmitter 51 in a state where the driving torque of the second agitator 22 is equal to or more than the first set value, the first torque limiter 63 is actuated. When the first torque limiter 63 is actuated as described above, the first driving piece 61 rotates with respect to the first driven piece 62, thereby the transmission of the rotation from the first transmitter 51 to the second transmitter 52 is restricted. Therefore, the transmission of the rotation to the second and third agitators 22, 23 are stopped, while the transmission of the rotation to the first agitator 21 is continued. According to this, the first agitator 21 rotates in a state where rotation of the second and third agitators 22, 23 are stopped.

When the first agitator 21 rotates as described above, the toner in the storage space S1 is conveyed to the discharge space S2 by the first agitator 21. The toner conveyed to the discharge space S2 is conveyed to the discharge port 38 by the conveyer 24, and discharged from the discharge space S2 via the discharge port 38.

When the toner in the storage space S1 is conveyed to the discharge space S2 by the first agitator 21, the toner in the periphery of the first agitator 21 is reduced, and the toner in the periphery of the second agitator 22 moves to the periphery of the first agitator 21. According to this, the driving torque of the second agitator 22 is reduced. When the driving torque of the second agitator 22 becomes less than the first set value, the first torque limiter 63 is not actuated when the rotation driving force of the driving source 82 is transmitted to the first connector 54. Therefore, the first driving piece 61 and the first driven piece 62 rotate integrally, and rotation is transmitted from the first transmitter 51 to the second transmitter 52. Incidentally, although the driving torque of the second agitator 22 becomes less than the first set value, the driving torque of the third agitator 23 is still equal to or more than the second set value.

When the rotation driving force of the driving source 82 is transmitted to the second connector 55 via the driving coupling 81, the first transmitter 51, the first connector 54, and the second transmitter 52 in a state where the driving torque of the third agitator 23 is equal to or more than the second set value, the second torque limiter 73 is actuated. When the second torque limiter 73 is actuated as described above, the second driving piece 71 rotates with respect to the second driven piece 72, thereby the transmission of the rotation from the second transmitter 52 to the third transmitter 53 is restricted. Therefore, the transmission of the rotation to the third agitator 23 is stopped, while the transmission of the rotation to the first and second agitators 21, 22 are continued. According to this, the first and second agitators 21, 22 rotate in a state where the rotation of the third agitator 23 is stopped.

When the first and second agitators 21, 22 rotate as described above, the toner in the storage space S1 is conveyed to the discharge space S2 by the first and second agitators 21, 22. The toner conveyed to the discharge space S2 is conveyed to the discharge port 38 by the conveyer 24, and discharged from the discharge space S2 via the discharge port 38.

When the toner in the storage space S1 is conveyed to the discharge space S2 by the first and second agitators 21, 22, the toner in the periphery of the first and second agitators 21, 22 is reduced, and the toner in the periphery of the third agitator 23 moves to the periphery of the first and second agitators 21, 22. According to this, the driving torque of the third agitator 23 is reduced. When the driving torque of the third agitator 23 becomes less than the second set value, the second torque limiter 73 is not actuated when the rotation driving force of the driving source 82 is transmitted to the second connector 55. Therefore, the second driving piece 71 and the second driven piece 72 rotate integrally, and rotation is transmitted from the second transmitter 52 to the third transmitter 53. Thus, rotation is transmitted to the first to third agitators 21-23, and the first to third agitators 21-23 rotate.

When the first to third agitators 21-23 rotate as described above, the toner in the storage space S1 is conveyed to the discharge space S2 by the first to third agitators 21-23. The toner conveyed to the discharge space S2 is conveyed to the discharge port 38 by the conveyer 24, and is discharged from the discharge space S2 via the discharge port 38.

As described above, when the driving torque of the second agitator 22 is equal to or more than the first set value, the transmitting mechanism 25 stops the transmission of the rotation to the second and third agitators 22, 23, while the transmitting mechanism 25 continues the transmission of the rotation to the first agitator 21. According to such a configuration, it is possible to rotate the first agitator 21 in a state where the rotation of the second and third agitators 22, 23 are stopped, when the toner is aggregated in the storage space S1. According to this, the driving torque of the second and third agitators 22, 23 is not applied to the driving part of the first to third agitators 21-23, and it is possible to reduce the torque applied to the above-mentioned driving part. Therefore, it is possible to prevent great load from being applied to the above-mentioned driving part, when the toner is aggregated in the storage space S1. Further, as described above, the first agitator 21 rotates in a state where the rotation of the second and third agitators 22, 23 are stopped, thereby it is possible to reduce the noise caused by the rotation of the first to third agitators 21-23, compared with the case where the first to third agitators 21-23 are always rotated simultaneously.

Further, when the driving torque of the second agitator 22 is equal to or more than the first set value, the first torque limiter 63 is actuated to restrict the transmission of the rotation from the first transmitter 51 to the second transmitter 52, and the transmission of the rotation to the second agitator 22 is stopped. According to such a configuration, the transmission of the rotation to the second agitator 22 is stopped with a simple structure.

Further, when the driving torque of the third agitator 23 is equal to or more than the second set value, the second torque limiter 73 is actuated to restrict the transmission of the rotation from the second transmitter 52 to the third transmitter 53, and the transmission of the rotation to the third agitator 23 is stopped. According to such a configuration, the transmission of the rotation to the third agitator 23 is stopped with a simple structure.

Further, the second set value at which the second torque limiter 73 is actuated is set to be equal to or less than the first set value at which the first torque limiter 63 is actuated. According to such a configuration, the first to third agitators 21-23 start to rotate in the order of first agitator 21, the second agitator 22, and the third agitator 23, thereby the toner in the storage space S1 can easily loosen.

Further, when the first torque limiter 63 is actuated, the first driving piece 61 rotates with respect to the first driven piece 62, and the transmission of the rotation from the first transmitter 51 to the second transmitter 52 is restricted. According to such a configuration, the transmission of the rotation from the first transmitter 51 to the second transmitter 52 can be restricted with a simple structure.

Further, the first agitator 21, which starts to rotate earliest of the first to third agitators 21-23, is arranged at a downstream side of the second and third agitators 22, 23 in the toner conveying direction A. According to such a configuration, it is possible for the first agitator 21 to securely convey the toner in the storage space S1, even in a state where the rotation of the second and third agitators 22, 23 are stopped.

Further, the first wall 33 arranged below the first agitator 21 is arranged higher the second wall 34 arranged below the second agitator 22. According to such a configuration, the toner is not likely to move from the second wall 34 side to the first wall 33 side, when the toner container 6 is inclined during its transportation. According to this, it is possible to prevent the aggregation of the toner in the periphery of the first agitator 21, and to smoothly rotate the first agitator 21.

Further, the first agitator 21 lifts the toner in the storage space S1 to the discharge space S2. When such a configuration is applied, the driving torque of the first agitator 21 is likely to get large. Therefore, the advantage of securely rotating the first agitator 21 by the above configuration is great.

Further, the image forming apparatus 1 includes the above-mentioned toner container 6. According to such a configuration, it is possible to supply the image forming apparatus 1 which can prevent the great load from being applied to the driving part of the first to third agitators 21-23.

Figure 6:
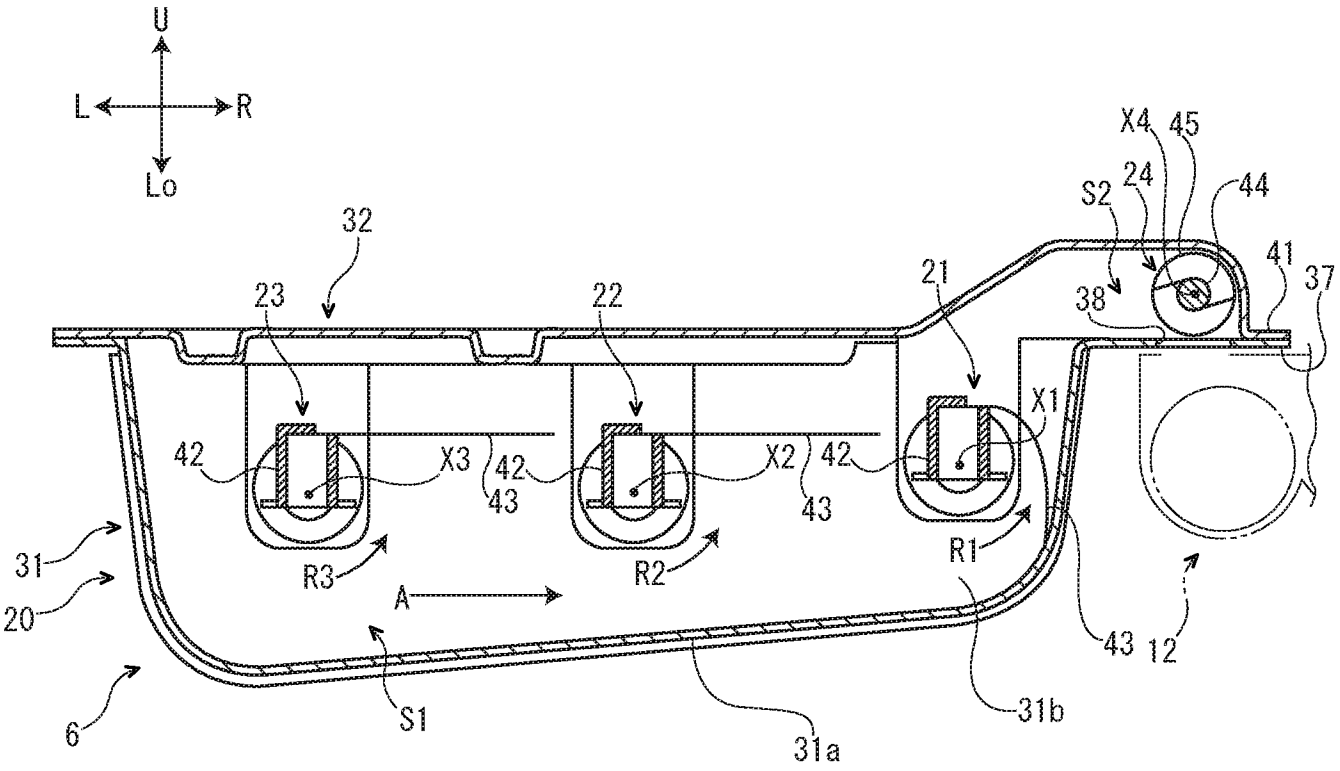
FIG. 6 is a sectional view showing a toner container according to another embodiment of the present disclosure.

In the present embodiment, as shown in FIG. 2, a part of the bottom wall 31*a* of the storing body 31 of the case main body 20 is arranged horizontally. On the other hand, in other embodiments, as shown in FIG. 6, the bottom wall 31*a* of the storing body 31 of the case main body 20 may be inclined downward from the downstream side to the upstream side in the toner conveying direction A. According to such a configuration, the toner is not likely to move from the upstream side to the downstream side in the toner conveying direction A, when the toner container 6 is inclined during its transportation. According to this, it is possible to prevent the aggregation of the toner in the periphery of the first agitator 21, and to smoothly rotate the first agitator 21.

In the present embodiment, the toner container 6 includes three agitators. On the other hand, in other embodiments, the toner container 6 may include two agitators, or may include equal to or more than four agitators.

In the present embodiment, the toner container 6 includes two torque limiters. On the other hand, in other embodiments, the toner container 6 may include one torque limiter, or may include equal to or more than three torque limiters.

In the present embodiment, the first torque limiter 63 restricts the transmission of the rotation from the first transmitter 51 to the second transmitter 52. On the other hand, in other embodiments, a mechanism (e.g. a clutch mechanism) other than the torque limiter may restrict the transmission of the rotation from the first transmitter 51 to the second transmitter 52. Similar modification can be applied to the transmission of the rotation from the second transmitter 52 to the third transmitter 53.

In the present embodiment, the image forming apparatus 1 is the multifunctional peripheral. On the other hand, in other embodiments, the image forming apparatus 1 may be a printer, a copying machine, a facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body configured to store a toner;

first and second agitators configured to rotate and to agitate the toner in the case main body; and a transmitting mechanism configured to transmit rotation to the first and second agitators, wherein the transmitting mechanism includes:

a first transmitter configured to rotate integrally with the first agitator;

a second transmitter configured to rotate integrally with the second agitator; and a first connector configured to connect the first transmitter with the second transmitter, and the first connector includes a first torque limiter, wherein when driving torque of the second agitator is equal to or more than a first set value, the first torque limiter is actuated to restrict the transmission of the rotation from the first transmitter to the second transmitter, and the transmission of the rotation to the second agitator is stopped while the transmitting mechanism continues the transmission of the rotation to the first agitator, wherein the first connector further includes:

a driving piece connected with the first transmitter; and a driven piece connected with the second transmitter, and the first torque limiter is arranged between the driving piece and the driven piece, wherein the driving piece rotates with respect to the driven piece and the transmission of the rotation from the first transmitter to the second transmitter is restricted, when the first torque limiter is actuated.

2. The toner case according to claim 1, further comprising a third agitator configured to rotate and to agitate the toner in the case main body, wherein the transmitting mechanism further includes:

a third transmitter configured to rotate integrally with the third agitator; and a second connector configured to connect the second transmitter with the third transmitter, and the second connector includes a second torque limiter, wherein the second torque limiter is actuated to restrict the transmission of the rotation from the second transmitter to the third transmitter, and the transmission of the rotation to the third agitator is stopped, when driving torque of the third agitator is equal to or more than a second set value.

3. The toner case according to claim 2, wherein the second set value at which the second torque limiter is actuated is set to be equal to or less than the first set value at which the first torque limiter is actuated.

4. The toner case according to claim 1, wherein the first agitator is configured to rotate around a first rotation axis extending along one direction, and the second agitator is configured to rotate around a second rotation axis extending along the one direction, wherein a boss protrudes from one end wall in the one direction of the case main body to an outside in the one direction, and the driving piece is rotatably attached to an outer circumference of the boss.

5. The toner case according to claim 4, wherein the driven piece is arranged at an inside of the driving piece in the one direction.

6. The toner case according to claim 1, wherein a driving gear which meshes with a gear of the first transmitter is arranged on an outer circumference of the driving piece, and a driven gear which meshes with a gear of the second transmitter is arranged on an outer circumference of the driven piece.

7. The toner case according to claim 1, wherein the case main body includes:

a storage space configured to store the toner; and a discharge space from which the toner is discharged, the discharge space being communicated with the storage space, and the first and second agitators are configured to agitate the toner in the storage space and to convey the toner in the storage space to the discharge space, the first agitator is arranged at a downstream side of the second agitator in a toner conveying direction from the storage space to the discharge space.

8. The toner case according to claim 7, wherein a bottom wall of the case main body includes:

a first wall arranged below the first agitator, and a second wall arranged below the second agitator, and the first wall is arranged higher than the second wall.

9. The toner case according to claim 7, wherein a bottom wall of the case main body is inclined downward from a downstream side to an upstream side in the toner conveying direction.

10. The toner case according to claim 7, wherein the discharge space is arranged higher than the storage space, and the first agitator is configured to lift the toner in the storage space to the discharge space.

11. An image forming apparatus comprising the toner case according to claim 1.

* * * * *